US011560528B2

(12) United States Patent
Delcotto et al.

(10) Patent No.: US 11,560,528 B2
(45) Date of Patent: Jan. 24, 2023

(54) WOODEN WICKS INCLUDING A BOOSTER FOR A CANDLE AND METHOD OF MAKING

(71) Applicant: DELCOTTO IP, LLC, North Huntingdon, PA (US)

(72) Inventors: Melynda Suzanne Delcotto, North Huntingdon, PA (US); Justin Damiani, Youngwood, PA (US)

(73) Assignee: DELCOTTO IP, LLC, North Huntingdon, PA (US)

( * ) Notice: Subject to any disclaimer, the term of this patent is extended or adjusted under 35 U.S.C. 154(b) by 221 days.

(21) Appl. No.: 16/813,868

(22) Filed: Mar. 10, 2020

(65) Prior Publication Data

US 2020/0208079 A1 Jul. 2, 2020

Related U.S. Application Data

(63) Continuation of application No. 15/711,095, filed on Sep. 21, 2017, now Pat. No. 10,626,348, which is a continuation of application No. 15/165,581, filed on May 26, 2016, now Pat. No. 9,796,946, which is a continuation of application No. 14/802,468, filed on (Continued)

(51) Int. Cl.

| | |
|---|---|
| ***F23D 3/08*** | (2006.01) |
| ***C11C 5/00*** | (2006.01) |
| ***B27D 1/00*** | (2006.01) |
| ***C11C 5/02*** | (2006.01) |
| ***B27M 1/08*** | (2006.01) |

(Continued)

(52) U.S. Cl.

CPC ..... *C11C 5/006* (2013.01); *B27D 1/00* (2013.01); *B27M 1/08* (2013.01); *C11C 5/02* (2013.01); *F23D 3/08* (2013.01); *F23D 3/16* (2013.01); *F23D 3/40* (2013.01)

(58) Field of Classification Search

CPC . C11C 5/006; C11C 5/02; B27D 1/00; B27M 1/08; F23D 3/08; F23D 3/16; F23D 3/40

USPC ..... 431/288, 289, 291

See application file for complete search history.

(56) References Cited

U.S. PATENT DOCUMENTS

| | | | |
|---|---|---|---|
| 52,231 | A | 1/1866 | Walton |
| 59,839 | A | 11/1866 | Hoard |

(Continued)

FOREIGN PATENT DOCUMENTS

| | | |
|---|---|---|
| DE | 314258 | 9/1918 |
| EP | 1245663 | 10/2002 |

(Continued)

OTHER PUBLICATIONS

Firewood for Your Fireplace; Warren Donnelly; Oct. 1974; pp. 18,25,34,35,37,84,85,88-95.

(Continued)

*Primary Examiner* — Avinash A Savani

(74) *Attorney, Agent, or Firm* — Element IP, PLC

(57) ABSTRACT

A wooden wick for use in a wax candle comprising a strip of a predetermined wood having each of a first predetermined length, a first predetermined width and a first predetermined thickness. Such wick further includes a wood booster member having each of a second predetermined length, a second predetermined width and a second predetermined thickness adhered to the strip of wood.

26 Claims, 4 Drawing Sheets

Related U.S. Application Data

Jul. 17, 2015, now Pat. No. 9,388,365, which is a continuation of application No. 13/296,629, filed on Nov. 15, 2011, now Pat. No. 9,120,995, which is a continuation-in-part of application No. 12/002,819, filed on Dec. 19, 2007, now Pat. No. 8,708,694.

(60) Provisional application No. 60/871,264, filed on Dec. 21, 2006.

(51) Int. Cl.
*F23D 3/16* (2006.01)
*F23D 3/40* (2006.01)

(56) References Cited

U.S. PATENT DOCUMENTS 123,917 A 2/1872 Ladd
133,973 A 12/1872 Everett
170,158 A 11/1875 Cushing
170,995 A 12/1875 Daniels
197,902 A 12/1877 Scott
239,855 A 4/1881 Schneider
252,590 A 1/1882 Loper
275,293 A 4/1883 Tisdale
276,602 A 5/1883 Kirk
323,058 A 7/1885 Mitchell
383,822 A 5/1888 Munger
415,231 A 11/1889 Walters
431,033 A 7/1890 Chapin
436,509 A 9/1890 Walters
486,966 A 11/1892 Elsinger
731,033 A 6/1903 Freeman
747,282 A 12/1903 Wallgren
827,066 A 7/1906 Hafner
1,267,968 A 5/1918 Bulle
1,320,109 A 10/1919 Wooster
1,389,490 A 8/1921 Cook et al.
1,475,134 A 11/1923 Oakes
1,576,205 A 3/1926 Mertens
1,636,709 A 7/1927 Schmidt
1,657,391 A 1/1928 Haney
1,660,760 A 2/1928 Murphy
1,756,885 A 4/1930 Schafer
1,831,902 A 11/1931 Brown
1,841,690 A 1/1932 Weindel, Jr.
1,961,920 A 6/1934 Arpin
2,015,383 A 9/1935 Konig et al.
2,107,054 A 2/1938 Haymond
D111,775 S 10/1938 Seaver
2,168,698 A 8/1939 Bunt et al.
2,241,167 A 5/1941 Storck
2,324,753 A 7/1943 Alexiade
2,354,343 A 7/1944 Webber et al.
2,373,512 A 4/1945 Starner
2,376,083 A 5/1945 Quinn
2,464,361 A 3/1949 Wilson
2,570,841 A 10/1951 O'Connor
2,611,254 A 9/1952 Byrnes
D178,200 S 7/1956 Mckenzie et al.
2,758,460 A 8/1956 Ciano
2,809,512 A 10/1957 Hartnett
2,811,428 A 10/1957 Smith
2,959,950 A 11/1960 Weglin
3,039,283 A 6/1962 Buscemi
3,086,658 A 4/1963 Palmer
3,175,876 A 3/1965 Fredericks
3,269,807 A 8/1966 Key, Jr.
3,286,492 A 11/1966 Frazier, Jr.
3,367,758 A 2/1968 Ambrose et al.
3,380,797 A 4/1968 Summers
3,428,409 A 2/1969 Summers
3,462,235 A 8/1969 Summer
3,466,135 A 9/1969 Summers
3,495,924 A 2/1970 Seni et al.
3,560,122 A 2/1971 Cassar
3,582,251 A 6/1971 Concannan
3,637,335 A 1/1972 Uhl
3,652,197 A 3/1972 Tokarz
3,706,523 A 12/1972 Kumm
3,759,478 A 9/1973 Schmitt et al.
3,761,702 A 9/1973 Andeweg
3,883,143 A 5/1975 Kelley et al.
3,998,922 A 12/1976 Weiss
4,304,547 A 12/1981 Buzil
4,380,200 A 4/1983 Reninger
4,381,914 A 5/1983 Ferguson
4,386,904 A 6/1983 Miyahara et al.
4,449,987 A 5/1984 Lindauer
4,477,249 A 10/1984 Ruzek et al.
4,557,687 A 12/1985 Schirneker
4,568,269 A 2/1986 Lin
4,568,270 A 2/1986 Marcus et al.
4,682,947 A 7/1987 Luken, Jr.
4,696,640 A 9/1987 Pitchford
4,725,286 A 2/1988 Brame
4,804,323 A 2/1989 Kim
D301,749 S 6/1989 Comstock
4,839,144 A 6/1989 Martin
4,855,098 A 8/1989 Taylor
4,917,597 A 4/1990 Henze
5,015,175 A 5/1991 Lee
5,069,617 A 12/1991 Lin
D350,566 S 9/1994 Pearson
5,354,197 A 10/1994 Barone
5,363,590 A 11/1994 Lee
5,487,658 A 1/1996 Lee
5,597,300 A 1/1997 Wohl et al.
5,683,239 A 11/1997 Cardosi
5,683,762 A 11/1997 Banschick
5,690,484 A 11/1997 Leonard et al.
5,762,487 A 6/1998 Kujawski
5,772,424 A 6/1998 Nokelainen
D397,459 S 8/1998 Hsu
5,807,096 A 9/1998 Shin et al.
5,830,245 A 11/1998 Raddon
5,842,850 A 12/1998 Pappas
5,846,070 A 12/1998 Kim et al.
5,879,153 A 3/1999 Slejertin
5,967,769 A 10/1999 Thompson
6,017,373 A 1/2000 Frisch
6,033,210 A 3/2000 Freeman
6,063,144 A 5/2000 Calzada et al.
6,068,472 A 5/2000 Freeman et al.
6,074,199 A 6/2000 Song
6,076,515 A 6/2000 Smith
6,129,771 A 10/2000 Ficke
6,214,295 B1 4/2001 Freeman
6,241,512 B1 6/2001 Freeman et al.
6,276,925 B1 8/2001 Varga
D456,537 S 4/2002 Leeds
D458,394 S 6/2002 Leeds
D459,498 S 6/2002 Araujo
6,405,441 B1 6/2002 Rucker
6,409,501 B1 6/2002 Pappas
6,419,713 B1 7/2002 Durand et al.
6,440,184 B2 8/2002 Noda et al.
6,444,156 B1 9/2002 Schwarz et al.
6,454,561 B1 9/2002 Colthar et al.
6,471,899 B2 10/2002 Daiber et al.
D466,632 S 12/2002 Lablaine
6,508,644 B1 1/2003 Pesu et al.
6,554,448 B2 4/2003 Carpenter
6,568,934 B1 5/2003 Butler
D481,142 S 10/2003 Leeds
6,783,356 B2 8/2004 Hermanson
D496,474 S 9/2004 Murdick
6,793,697 B2 9/2004 Sprules et al.
6,823,780 B2 11/2004 Vogt et al.
6,921,260 B2 7/2005 Garnys
6,991,453 B2 1/2006 Decker et al.
D590,078 S 4/2009 Horenziak et al.
7,524,339 B2 4/2009 Decker et al.
7,568,913 B2 8/2009 Decker et al.

(56) References Cited

U.S. PATENT DOCUMENTS

| | | | | |
|---|---|---|---|---|
| 7,850,444 | B2 | 12/2010 | Kubicek et al. | |
| D637,741 | S | 5/2011 | Horenziak et al. | |
| D643,554 | S | 8/2011 | Decker | |
| D644,359 | S | 8/2011 | Decker | |
| D644,360 | S | 8/2011 | Decker | |
| D658,316 | S | 4/2012 | Van Dijk | |
| D663,450 | S | 7/2012 | Delcotto et al. | |
| D669,615 | S | 10/2012 | Delcotto et al. | |
| 8,348,662 | B2 | 1/2013 | Decker | |
| D678,558 | S | 3/2013 | Decker | |
| 8,708,694 | B2 | 4/2014 | Delcotto et al. | |
| D705,459 | S | 5/2014 | Decker | |
| D708,777 | S | 7/2014 | Delcotto et al. | |
| D715,989 | S | 10/2014 | Delcotto et al. | |
| 8,961,171 | B2 | 2/2015 | Decker | |
| 9,039,409 | B2 | 5/2015 | Decker | |
| 9,120,995 | B2 | 9/2015 | Delcotto et al. | |
| D740,461 | S | 10/2015 | Decker | |
| 9,261,275 | B2 | 2/2016 | Decker | |
| 9,410,696 | B2 | 8/2016 | Decker | |
| 2001/0029003 | A1 | 10/2001 | Zou | |
| 2001/0043469 | A1 | 11/2001 | Carpenter et al. | |
| 2002/0013444 | A1 | 1/2002 | Jones et al. | |
| 2002/0018976 | A1 | 2/2002 | Zou | |
| 2002/0022205 | A1 | 2/2002 | Elliott et al. | |
| 2003/0036028 | A1 | 2/2003 | Pesu et al. | |
| 2003/0162142 | A1 | 8/2003 | Bennetts et al. | |
| 2003/0235797 | A1* | 12/2003 | McCullough ..... | F23D 3/18 431/325 |
| 2004/0008509 | A1 | 1/2004 | Decker et al. | |
| 2004/0009447 | A1 | 1/2004 | Decker | |
| 2004/0029061 | A1 | 2/2004 | Dibnah et al. | |
| 2004/0033463 | A1 | 2/2004 | Pesu et al. | |
| 2005/0037307 | A1 | 2/2005 | Decker et al. | |
| 2005/0037308 | A1 | 2/2005 | Decker | |
| 2005/0115145 | A1 | 6/2005 | Decker et al. | |
| 2008/0153046 | A1 | 6/2008 | Delcotto et al. | |
| 2011/0024945 | A1 | 2/2011 | Decker | |
| 2011/0027735 | A1 | 2/2011 | Decker | |
| 2011/0027736 | A1 | 2/2011 | Decker | |
| 2011/0027737 | A1 | 2/2011 | Decker | |
| 2011/0225392 | A1 | 9/2011 | Barry et al. | |
| 2012/0064467 | A1 | 3/2012 | Delcotto et al. | |
| 2012/0129114 | A1 | 5/2012 | Barresi | |
| 2012/0148966 | A1 | 6/2012 | Ramaker et al. | |
| 2012/0202160 | A1 | 8/2012 | Ford | |
| 2012/0264069 | A1 | 10/2012 | Ramirez | |
| 2013/0095440 | A1 | 4/2013 | Cagle et al. | |
| 2013/0112346 | A1 | 5/2013 | Cagle et al. | |
| 2015/0322379 | A1 | 11/2015 | Delcotto et al. | |

FOREIGN PATENT DOCUMENTS

| | | |
|---|---|---|
| FR | 2 639 356 | 5/1990 |
| FR | 2 725 372 | 4/1996 |
| FR | 2 726 573 | 5/1996 |
| FR | 2 811 676 | 1/2002 |
| GB | 16702 | 3/1915 |
| GB | 191516702 | 3/1916 |
| GB | 118741 | 11/1917 |
| GB | 1238214 | 9/1968 |
| GB | 1558713 | 3/1977 |
| JP | 2932371 | 5/1999 |
| SE | 9903818 | 5/2000 |

OTHER PUBLICATIONS www.CLARLUSSP.com/candles/index.php, "Waxes: Candles." Internet printout on Jul. 6, 2006, 1 page.

www.wetesilt.com/wax.htm, "Wax." Internet printout on Jul. 6, 2006, 3 pages.

European Office Action dated Aug. 30, 2017, in European patent Application No. 12 191 762.9.

Improvements Catalog, [Online], [Retrieved on Jan. 11, 2005], Retrieved from the Internet: http://www.improvementscatalog.com/Parent.asp?product=240717x&dept%5Fid=300&subdept%5Fid=304>.

World Flame Catalog, [Online], [Retrieved on Jan. 11, 2005], Retrieved from the Internet: http:f/www.golightheworld.com/Store/ProductJCategoryInfo.aspx?cid=7>.

World Flame Catalog, [Online], [Retrieved on Jan. 11, 2005]. Retrieved from the Internet: http://www.golightheworld.com/Store/ProducUCategoryInfo.aspx?cid=17>.

Norma Coney, 2000, Lark Books, Deborah Morgenthal, pp. 16, 49-50, & 55-58.

Request for Ex Parte Reexamination of U.S. Pat. No. 8,961,171, dated Apr. 29, 2016.

Request for Ex Parte Reexamination of U.S. Patent No. 8,961,171; Replacement Detailed Request dated Jun. 10, 2016.

Internet Article, "Wood Candle Wicks—Crackling Wooden Wicks," http://www.woodcandlewick.com, p. 1-6 (Sep. 28, 2015}.

Internet Article, "Wood Candle Wicks—Crackling Wooden Wicks," http:f/www.woodcandlewick.com p. 1-6 (Sep. 28, 2015).

Nussle, W., "Candle Crafting from an Art to a Science," A.S. Barnes and Co., Inc. (1971} pp. 16-17.

Olden, D ., "Candles that Earn", Peanut Butter Publishing, (1990), Chapter 8, pp. 153-160.

Olden, D ., "Candles that Earn", Peanut Butter Publishing, (1990), Chapter 7, pp. 133-153.

Robbins, F.W., "The Story of the Lamp (And the Candle)", (Reprint 1970), Kingsmead Reprints. Bath, pp. 16-23.

Wood Handbook, Wood as an Engineering Material, Centennial Edition, USDA (Apr. 2010).

Global Design Database, Registration No. 49900086-0001 (Apr. 11, 2019).

Global Design Database, Registration No. 40100590-0029 (Apr. 11, 2019).

* cited by examiner

WOODEN WICKS INCLUDING A BOOSTER FOR A CANDLE AND METHOD OF MAKING

CROSS REFERENCE TO RELATED APPLICATIONS

This application is a continuation U.S. patent application Ser. No. 15/711,095, filed Sep. 21, 2017, which is a continuation of U.S. patent application Ser. No. 15/165,581, filed May 26, 2016, now U.S. Pat. No. 9,796,946, which is a continuation of U.S. patent application Ser. No. 14/802,468, filed Jul. 17, 2015, now U.S. Pat. No. 9,388,365, which is a continuation of U.S. Patent application Ser. No. 13/296,629, filed Nov. 15, 2011, now U.S. Pat. No. 9,120,995, which is a continuation-in-part of U.S. patent application Ser. No. 12/002,819 filed Dec. 19, 2007, now U.S. Pat. No. 8,708,694, which claims the benefit of U.S. Provisional Patent Application No. 60/871,264, filed Dec. 21, 2006, all of which are incorporated herein by reference in their entirety.

BACKGROUND OF THE INVENTION

Field of the Invention

The present invention relates, in general, to wicks for candles and, more particularly, this invention relates to a wooden wick equipped with a booster for a candle and to a method of making such wooden wick.

Description of Related Art

Prior to the conception and development of the present invention, as is generally well known in the prior art, candles and wicks which are lit to provide a flame and which melts the wax surrounding such wick have been in existence and commercially available for many years.

These prior art type wicks have normally been produced from a cloth fiber and are embedded into an appropriate portion of the wax, generally in the center, forming the candle. Wicks formed from pieces of wood have also been used; however, these wooden wicks have been formed as a single piece of wood which has a number of distinct disadvantages.

One particular disadvantage of these prior art type wooden wicks is that they are not attractive. Another important disadvantage of the prior art wooden wicks is that they have less than ideal burn qualities (e.g., smoke and soot emitted, inconsistent burning of wick, inconsistent wax burning, etc.).

SUMMARY OF THE INVENTION

The present invention provides, in a first aspect, a wooden wick for use in a wax candle. This wooden wick includes a strip of a predetermined wood having each of a first predetermined length, a first predetermined width and a first predetermined thickness. Such wick further includes a booster member having each of a second predetermined length, a second predetermined width and a second predetermined thickness and a means for adhering the booster member to such strip of wood. The booster member can be constructed from wood to form a strip of wood.

In a second aspect, the present invention provides a method of manufacturing a wooden wick for use in a wax candle. The method includes the steps of selecting a type of wood to be formed into a strip of wood to be used in the wooden wick. Thereafter, cutting such wood selected into such strip having each of a first predetermined length, a first predetermined width and a first predetermined thickness.

The method includes the steps of selecting a type of wood to be formed into a strip of wood to be used in a booster member, then cutting such wood selected into such strip having each of a first predetermined length, a first predetermined width and a first predetermined thickness and adhering such booster member to the strip of wood forming the wick Preferably, the wicks and booster are constructed of all natural components. The booster is a very important part of the wick, which enables the wick to burn in natural candle wax. A single piece of wood will not burn well in natural wax. Also an untreated wood will not burn consistently through a natural wax. Natural waxes should be considered as any waxes derived from animal or plant sources. Preferably a vegetable wax, such as soy wax, jojoba wax, bayberry wax, candelilla wax, carnauba wax, castor wax or a combination thereof, is used.

An important benefit to having two wood pieces as a wick is that this allows for optimization of the wick's burning properties by selecting different sizes and species of wood for the wick and booster components. The wood can be any combination of species depending on the heat output that is desired. Cherry, oak, birch, maple, balsa, and rosewood species are examples of woods that could be used in constructing the wick.

The wood is cut into sheets or strips of a desired thickness. Once cut the wood of the wick and the booster are treated. The wood is sprayed with a coating of a solution of soy oil, salt water and vinegar, in a specific example a solution of 60% soy oil, 30% salt water and 10% white distilled vinegar is effectively used. The soy oil aids in a consistent burn of the wick. While the salt water aides in increasing the moisture content of the wick. The vinegar acts a natural anti-fungal to prevent fouling of the wick during storage and shipping.

After treatment with the above solution the wood is then placed into a plastic bag and placed into a vacuum to pull the solution into the wood. The wood may be maintained in a vacuum for several hours to several days to fully pull the solution in the wood. When the wood is removed from the vacuum it may be cut further into the desired sizes. The booster is then glued to the base piece with a all natural vegetable glue, the glue is applied in a S pattern, this allows the booster to act as a chimney for the steam that is created by the additional water in the solution that was infused into the wood, while the soy oil assures that the wood will be able to burn hot enough to melt natural candle waxes. The glue or adhesive could be applied in other patterns or in place of or in combination with other glue application patterns. While an S pattern has been found to be very effective in regard to wick performance and manufacturing efficiency, other patterns that allow for a chimney effect to occur and keep the wick components closely bound could also be effective.

After treatment with the above solution the wood is then placed into a plastic bag and placed into a vacuum to pull the solution into the wood. The wood may be maintained in a vacuum for several hours to several days to fully pull the solution in the wood. When the wood is removed from the vacuum it may be cut further into the desired sizes. The booster is then glued to the base piece with a all natural vegetable glue, the glue is applied in a S pattern, this allows the booster to act as a chimney for the steam that is created by the additional water in the solution that was infused into the wood, while the soy oil assures that the wood will be able to burn hot enough to melt natural candle waxes. The glue or adhesive could be applied in other patterns or in place of or in combination with other glue application patterns. While an S pattern has been found to be very effective in regard to wick performance and manufacturing efficiency, other patterns that allow for a chimney effect to occur and keep the wick components closely bound could also be effective.

Once the glue is applied to the wood pieces, they can be placed on presser boards to dry and keep the wood flat. Low heat is applied to assist in the drying process of the wood wicks. An oil is then applied, preferably by spraying, to the wood pieces of the wick. Preferably a vegetable oil such as soy oil is used, but other oil or wax formulations could be used if they have the needed burn qualities. The wood is then wrapped in a plastic wrap or the like to protect the moisture level of the wicks.

Once constructed the wicks can be used as a wick in a candle by embedding the wick into wax, preferably a vegetable wax. When burning the wick of the present invention the two pieces of wood separate slightly to create a chimney effect. The two wooden pieces should be attached to ensure the two pieces of wood stay close to each other. Otherwise if the two pieces warp and separate, the result is two separate out of control flames.

The present invention provides, in a second aspect a method of manufacturing a wooden wick for use in a wax candle. The method includes selecting a type of wood to be formed into a strip of wood to be used in such wooden wick. Then, cutting the wood selected into such strip having each of a first predetermined length, a first predetermined width and a first predetermined thickness.

Additionally, the method includes forming a booster member having each of a second predetermined length, a second predetermined width and a second predetermined thickness and then adhering such booster member to such strip of wood. Preferably, an adhesive is selected for adhering the booster member to such strip of wood.

In the preferred embodiment, such method further includes an addition step of ensuring that the strip of wood is clean before such strip of wood is adhered to the booster member and further that such strip of wood is treated with a liquid wax and that the wooden wick is cured, preferably by baking, prior to use in such candle. It is further preferred that the booster member be soaked in a soy oil prior to adhering it to said strip of wood. Thereafter said booster member is coated with a wax type material.

Additionally, the method includes an additional step of drying the wooden wick for a predetermined time generally for about 48.0 hours, prior to use in such candle.

The wooden wick 10 further includes a coloring agent to stain the wooden strip 12 for enhancing a visual appearance thereof. Preferably, such coloring agent is a vegetable type coloring agent.

OBJECTS OF THE INVENTION

It is, therefore, one of the primary objects of the present invention to provide an improved wooden wick for use in a wax candle.

Another object of the present invention is to provide a method of producing such wooden wick Still another object of the present invention is to provide a wooden wick for use in a wax candle which is relatively inexpensive to produce.

Yet another object of the present invention is to provide a wooden wick for a wax candle which has enhanced visual appeal.

An additional object of the present invention is to provide a method of producing a wooden wick for a wax candle which will exhibit enhanced burn qualities.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

BRIEF DESCRIPTION OF THE INVENTION

Figure 1:
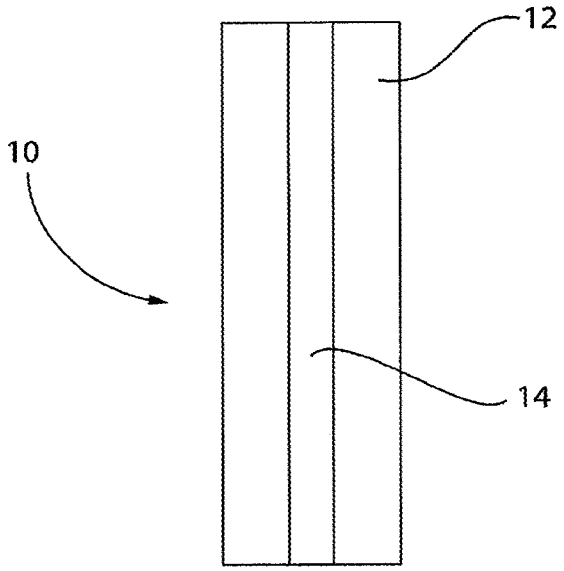
FIG. 1 is a plan view of a wooden wick according to an embodiment of the invention.

Prior to proceeding to the more detailed description of the present invention it should be noted that, for the sake of clarity and understanding, identical components which have identical functions have been identified with identical reference numerals throughout the several views illustrated in the drawing figures.

Figure 2:
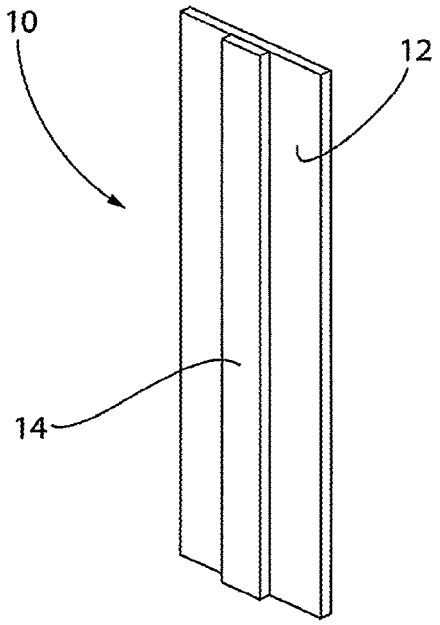
FIG. 2 is a perspective view of a wooden wick according to an embodiment of the invention.
Figure 3:
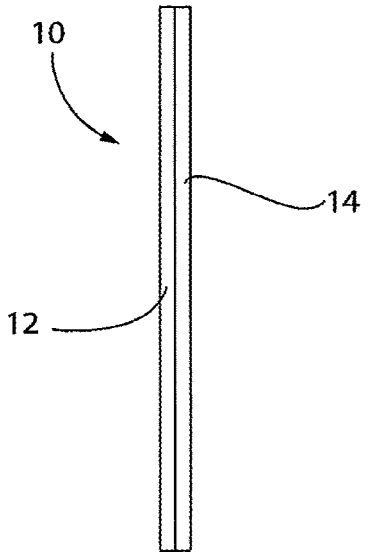
FIG. 3 is a profile view of a wooden according to an embodiment of the invention.

Reference is now made, more particularly, to FIGS. 1-3 which show an embodiment of the wick of the present invention. Illustrated therein is a wooden wick, generally designated 10, for use in a wax candle (not shown). The wooden wick 10 includes a strip of a predetermined wood 12 having each of a first predetermined length, a first predetermined width and a first predetermined thickness. Further, the wooden wick, according to the present invention, includes a booster member 14 having each of a second predetermined length, a second predetermined width and a second predetermined thickness.

Figure 4:
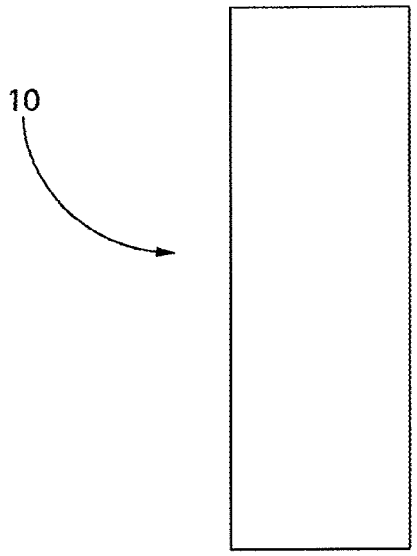
FIG. 4 is a plan view of a wooden wick according to another embodiment of the invention.
Figure 5:
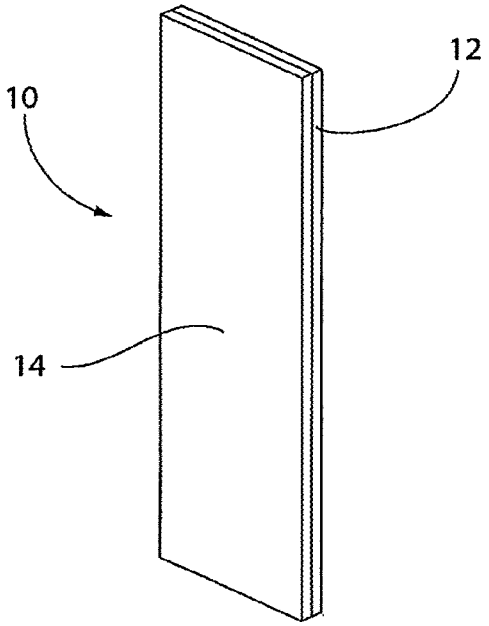
FIG. 5 is a perspective view of a wooden wick according to another embodiment of the invention.
Figure 6:
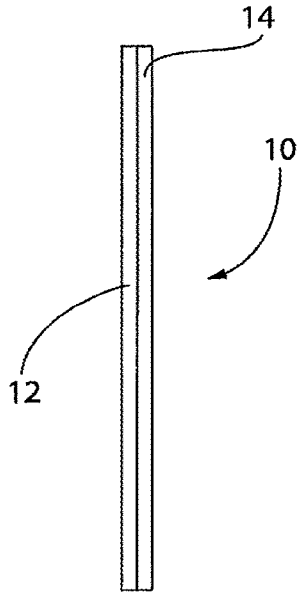
FIG. 6 is a profile view of a wooden according to another embodiment of the invention.

Reference is now made, more particularly, to FIGS. 4-6 which show an embodiment of the wick of the present invention. Illustrated therein is a wooden wick, generally designated 10, for use in a wax candle (not shown). The wooden wick 10 includes a strip of a predetermined wood 12 having each of a first predetermined length, a first predetermined width and a first predetermined thickness. Further, the wooden wick, according to the present invention, includes a booster member 14 having each of a second predetermined length, a second predetermined width and a second predetermined thickness.

In one embodiment of the invention, the first predetermined length of such strip of wood 12 will generally be between about 4.375 and about 5.125 inches. In this embodiment, the first predetermined width of the strip of wood 12 will generally be between about 0.70 inch and about 0.80 inch. In one embodiment of the invention, the second predetermined length of such booster member 14 will generally be between about 3.45 and about 3.55 inches and the second predetermined width of the booster member 14 will generally be between about 0.70 inch and about 0.80 inch. Further, in this embodiment such first and second predetermined thickness will be substantially identical.

Figure 7:
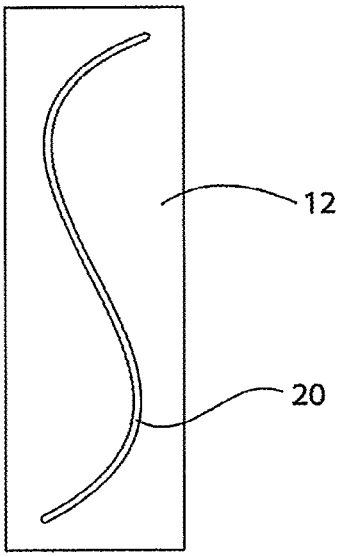
FIG. 7 is a plan view of a wooden wick according to another embodiment of the invention with adhesive applied in an S pattern.
Figure 8:
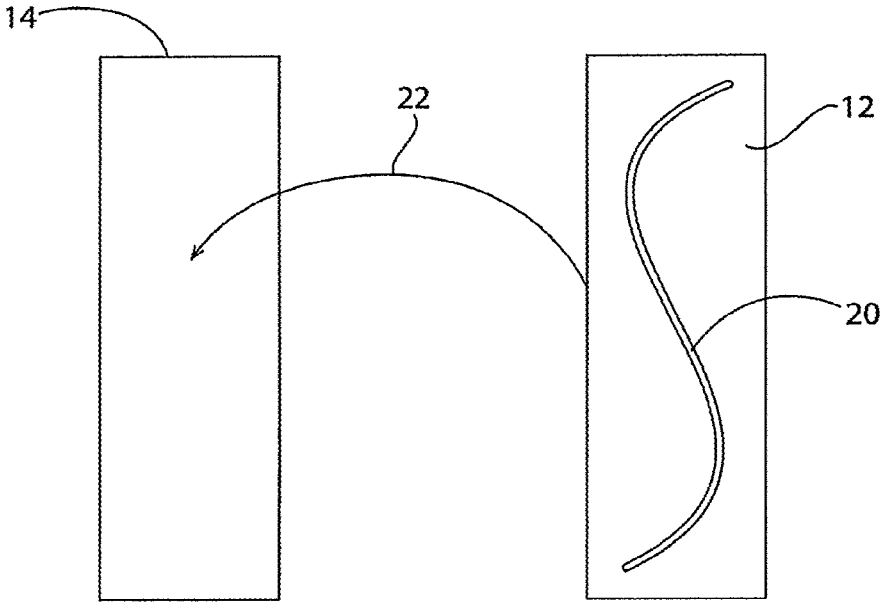
FIG. 8 is a plan view of a wooden wick according to another embodiment of the invention with adhesive applied in an S pattern and booster member ready to receive the wooden wick.

Reference is now made, more particularly, to FIGS. 7 and 8 which show an embodiment of the wick of the present invention in the assembly process. Strip of wood 12 comprises a means for adhering the booster member 14 to such strip of wood 12. Such means is preferably an adhesive 20. Adhesive 20 is preferably applied in an S pattern as shown in FIGS. 7 and 8. The strip of wood 12 is then mated with booster member 14 as directed by directional arrow 22. This configuration has been shown keep the strip of wood 12 and booster member 14 closely bound to each other while still allowing gases, steam and air to move between the strip of wood 12 and booster member 14. Other means for adhering the booster member to strip of wood 12 could comprise at least one fastener, clip, band, rivet, epoxy, cement, or the like.

Figure 9:
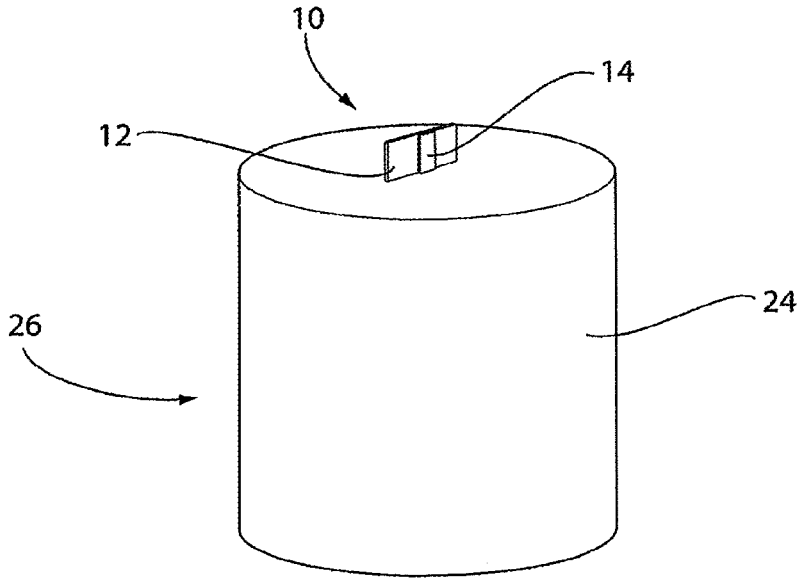
FIG. 9 is a perspective view of a candle comprising a wooden wick with a booster member.

Reference is now made to FIG. 9 which shows the wick 10 embedded in wax 24 to create candle 26.

Figure 10:
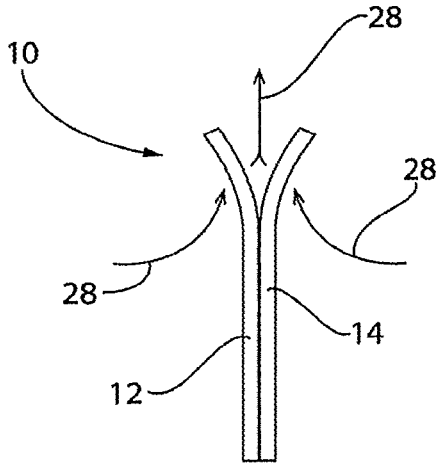
FIG. 10 is a close up profile view of a portion of the wooden wick with a booster member showing airflow while burning the wick.

Reference is now made to FIG. 10 which shows the wick 10 with directional arrows 28 which indicate the general direction of air and gas movement while the wick 10 is burning. The chimney effect of the wick 10 has a significant effect on the efficient burning of the wick 10 and the candle 26 as a whole. The extent of the peeling away between the wood strip 12 and booster member 14 is exaggerated in this drawing for illustrative purposes.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

The invention claimed is:

1. A wick, comprising:

a planar strip of wood having each of a first predetermined length, a first predetermined width, and a first predetermined thickness; and a secondary planar member having each of a second predetermined length, a second predetermined width, and a second predetermined thickness;

wherein the planar strip of wood is attached to the secondary planar member in a manner allowing gases, steam, and air to move between the planar strip of wood and the secondary planar member.

2. The wick according to claim 1, wherein at least one of the planar strip of wood and the secondary planar member is treated with an oil.

3. The wick according to claim 1, wherein the first predetermined thickness and the second predetermined thickness are substantially identical.

4. A method of manufacturing the wick for according to claim 1, comprising:

cutting a wood into the planar strip;

forming the secondary planar member; and attaching the secondary planar member to the planar strip of wood in a manner allowing gases, steam, and air to move between the planar strip of wood and the secondary planar member.

5. The method according to claim 4, further comprising drying the wick.

6. The method according to claim 5, further comprising soaking the wick in an oil.

7. The wick according to claim 1, wherein the first predetermined length and the second predetermined length are substantially identical.

8. The wick according to claim 1, wherein the first predetermined width and the second predetermined width are substantially identical.

9. The wick according to claim 1, wherein the first predetermined length and the second predetermined length are different.

10. The wick according to claim 1, wherein the first predetermined width and the second predetermined width are different.

11. The wick according to claim 1, wherein the first predetermined thickness and the second predetermined thickness are different.

12. The wick according to claim 1, wherein the planar strip of wood comprises at least one selected from the group consisting of cherry, oak, birch, maple, balsa, and rosewood.

13. A candle, comprising a wax and the wick according to claim 1 embedded in the wax.

14. A wick, comprising:

a planar strip of wood having each of a first predetermined length, a first predetermined width, and a first predetermined thickness; and a secondary planar member having each of a second predetermined length, a second predetermined width, and a second predetermined thickness;

wherein the planar strip of wood is clipped to the secondary planar member in a manner allowing gases, steam, and air to move between the planar strip of wood and the secondary planar member.

15. The wick according to claim 14, wherein at least one of the planar strip of wood and the secondary planar member is treated with an oil.

16. The wick according to claim 14, wherein the first predetermined length and the second predetermined length are substantially identical.

17. The wick according to claim 14, wherein the first predetermined width and the second predetermined width are substantially identical.

18. The wick according to claim 14, wherein the first predetermined thickness and the second predetermined thickness are substantially identical.

19. The wick according to claim 14, wherein the first predetermined length and the second predetermined length are different.

20. The wick according to claim 14, wherein the first predetermined width and the second predetermined width are different.

21. The wick according to claim 14, wherein the first predetermined thickness and the second predetermined thickness are different.

22. The wick according to claim 14, wherein the planar strip of wood comprises at least one selected from the group consisting of cherry, oak, birch, maple, balsa, and rosewood.

23. A candle, comprising a wax and the wick according to claim 14 embedded in the wax.

24. A method of manufacturing the wick according to claim 14, the method comprising:

cutting a wood into the planar strip;

forming the secondary planar member;

clipping the secondary planar member to the planar strip of wood in a manner allowing gases, steam, and air to move between the planar strip of wood and the secondary planar member.

25. The method according to claim 24, further comprising drying the wick.

26. The method according to claim 6, further comprising soaking the wick in an oil.

* * * * *